United States Patent [19]

Jeschke

[11] 4,112,842

[45] Sep. 12, 1978

[54] DRIVE FOR SHEET-FED ROTARY PRINTING PRESSES WITH AT LEAST TWO TANDEM-MOUNTED PRINTING UNITS

[75] Inventor: Willi Jeschke, Heidelberg-Boxberg, Germany

[73] Assignee: Heidelberger Druckmaschinen Aktiengesellschaft, Heidelberg, Germany

[21] Appl. No.: 496,169

[22] Filed: Aug. 9, 1974

[30] Foreign Application Priority Data

Oct. 31, 1973 [DE] Fed. Rep. of Germany ..... 2354541
Aug. 9, 1973 [DE] Fed. Rep. of Germany ..... 2340263

[51] Int. Cl.[2] ..... B41F 5/02
[52] U.S. Cl. ..... 101/183; 101/216
[58] Field of Search ..... 74/410, 427; 101/183, 101/184, 185, 181, 136, 137, 142, 177, 229, 230, 231, 216

[56] References Cited

U.S. PATENT DOCUMENTS

| | | | |
|---|---|---|---|
| 1,037,205 | 9/1912 | Clark | 74/427 |
| 1,113,172 | 10/1914 | Fassett | 74/427 |
| 1,140,357 | 5/1915 | Clark | 74/427 |
| 1,409,319 | 3/1922 | Vaughan | 74/410 |
| 1,430,274 | 9/1922 | Alger | 101/181 X |
| 1,551,474 | 8/1925 | Fassett | 74/427 |
| 2,115,975 | 5/1938 | Harrold | 101/136 X |
| 2,297,005 | 9/1942 | Livingston | 101/350 X |
| 2,425,680 | 8/1947 | Kaddeland | 101/184 |
| 2,439,454 | 4/1948 | Crafts | 101/216 |
| 2,898,851 | 8/1959 | Peyrebrune | 101/231 X |
| 3,007,406 | 11/1961 | Papa et al. | 101/183 |
| 3,221,651 | 12/1965 | Tagliasacchi | 101/183 |
| 3,511,179 | 5/1970 | Breunig | 101/183 |

FOREIGN PATENT DOCUMENTS

| | | | |
|---|---|---|---|
| 967,417 | 8/1964 | United Kingdom | 101/183 |

*Primary Examiner*—J. Reed Fisher
*Attorney, Agent, or Firm*—Herbert L. Lerner

[57] ABSTRACT

Drive for sheet-fed rotary printing machines with at least two tandem-mounted printing units driven by a closed gear train and including a drive motor including a drive train driven by the motor and extending parallel to the closed gear train, at least two force input locations connecting the closed gear train to the drive train a first displaceably mounted transmission member connected forward of one of the force input locations, a second transmission member corresponding to the first member connected forward of the other of the force input locations, and transmission means connecting the first transmission member to the second transmission member.

3 Claims, 3 Drawing Figures

DRIVE FOR SHEET-FED ROTARY PRINTING PRESSES WITH AT LEAST TWO TANDEM-MOUNTED PRINTING UNITS

The invention relates to a drive for multi-color sheet-fed rotary printing machines or presses with tandem-mounted printing units and, more particularly, with such printing machines that are driven by a closed gear train that is connected through at least two force input locations with a drive or transmission train driven by a motor and extending parallel to the gear train.

In heretofore known multi-color sheet-fed rotary printing machines of this general type, force transmission is effected through the main drive shaft to the printing units or to the transfer cylinders, for the most part, at two force input locations of the closed gear train, with the aid of worm or bevel gear transmissions. The closed gear train is conducive to the exact synchronization of the printing units. Both force input locations have as their objective the attainment of a favorable load distribution. Both the closed gear train and the double force input are consequently advantageous, but necessarily produce, however, an excessively or overly defined drive.

This overdefining results in an indeterminate power flow. Without special devices, there is no assurance that, for example, when using two worm drives or transmissions, each drive will always transmit the same or a specific amount of power. Furthermore, there is no assurance that the synchronizing gears will always remain in meshing engagement with the same tooth flanks. If load deviations should occur namely at the impression cylinders or transfer cylinders, a raising of the working or operating flanks of those gears which transmit only a little or no part of the load would result. Even if the play between or backlash of the teeth is depressed to the extreme minimum, misprints or faulty printing can arise therefrom.

To avoid the change of the drive flanks of the gears in the gear train, a division of the torques into individual drive or transmission groups at a predetermined ratio or proportion with respect to one another occurs in a drive known heretofore from German Pat. No. 1,237,140, through a branching differential in the drive train. This measure alone is insufficient, however, if the power demand of the individual printing units varies in their relationship one to the other, because the power distribution effected through the differential remains constant. A change in the direction of the power flow between individual printing units is thereby possible and, consequently, a flank change with the disadvantageous consequences thereof is produced. A power flow continuously effective in one direction and present in the endangered part of the gear train can thus not be attained solely through a predetermined power branching. Moreover, the heretofore known drive is exceptionally costly because of the use of planetary gears.

It is furthermore generally known to brace overdefined drives. The elasticity of all drive or transmission members permits, during shutdown or standstill of the machine, the attainment of a definite flank layout of the synchronizing gears through suitable assembly. Due to load variations during operation and the given, nonvariable rigidity of the individual drive or transmission trains, there is no assurance, however, that the definite flank layout will be maintained under all operating conditions, provided that direction and amount of the bracing or stressing are not selected so that, in the operating condition, the total power plus the reactive or idle power circulating due to the bracing or stressing is fed through only one force input location. The selected double drive consequently, at least with respect to the load distribution, has lost all of its meaning.

It is accordingly an object of the invention to feed a predetermined portion of the power to each force input location of the gear train by relatively simple means so that an overdefining of the drive is avoided.

With the foregoing and other objects in view, there is provided in accordance with the invention, a drive for sheet-fed rotary printing machines with at least two tandem-mounted printing units driven by a closed gear train and including a drive motor comprising a drive train driven by the motor and extending parallel to the closed gear train, at least two force input locations connecting the closed gear train to the drive train, a first displaceably mounted transmission member connected forward of one of the force input locations, a second transmission member corresponding to the first member connected forward of the other of the force input locations, and transmission means connecting the first transmission member to the second transmission member.

The displaceable bearing as well as the mutual supporting or bracing of the given transmission members ensure that, under all operating conditions of the machine, for example, 50% of the power will be fed into each of two force input locations. If one force input location, for example, lies between the printing units 1 and 2 and the other between the printing units 3 and 4, whereby each is supplied with 50% of the power, and if one assumes that the sheet feeder consumes 5%, the printing units 20% each, and the delivery system 15% of the total power, there then flows in the middle, endangered part of the gear train from the printing unit 2 to the printing unit 3, a power of 10%. Based upon experience, there should be no fear that this 10% partial power would be consumed due to lead deviations of the forward aggregates or printing units of the multicolor sheet-fed rotary printing machines, so that in none of the operating conditions, an overdefining or an undefined condition of the drive occurs. This inventive effect is attained, for example, in a very simple manner by providing that the main drive shaft which has two drive worms and which is of continuous construction without any coupling, is mounted so as to be freely displaceable in axial direction thereof.

If the power should be divided differently than 50:50, then a transmission or gear member can be connected to each of the force input locations forward thereof, and can be provided with a displaceable bearing, these bearings being mutually braced or supported with the intermediary of a force transducer. This force transducer can be constructed in its simplest form as a lever rod system. Without doubt, such a lever rod system is considerably simpler and also less costly to produce as compared to planetary gears or transmissions of the heretofore known drives of this general type. The force transducing or converting can be effected, however, in any other manner, such as hydraulic, for example.

In order to vary the partial amounts of power allotted to the individual force input locations, so that a possibly different load characteristic of the individual aggregates of a multicolor sheet-fed rotary printing machine can be matched independently of the location of the force input location, there is provided in accordance with another feature of the invention that the force transducer is regulatable or controllable.

The drive constructed in accordance with the invention permits the power that is to be fed to the gear train through the force input locations branch or divide in such a way matching the power requirements of the individual aggregates of the machine that power will always flow in the same direction in the endangered part of the gear train. A change in the driving flanks of the gears in the gear train can no longer occur. Consequently, so-called doubling difficulties in multicolor sheet-fed offset printing machines or misalignments in multicolor sheet-fed book printing machines, insofar as they are caused by tooth flank change, are completely avoided.

Through the displaceable arrangement of the bearings or bearing-supported members, an equilibrium condition is set through the gear train, on the one hand, and the transmission members, on the other hand. Adjustment of the force transducer determines the respective amount of power to be fed to the various force input locations. Adjustment of the force transducer can be effected manually or automatically.

In accordance with an additional feature of the invention, the drive train is constructed as a bipartite main drive shaft, both parts of the main drive shaft being coupled to one another so as to be displaceable relative to one another in axial direction, and including a worm respectively secured to each part of the main drive shaft, a worm gear respectively meshing with each of the worms at a respective force input location, each of the main drive shaft parts being mounted in respective bearings so as to be axially displaceable, the bearings of the main driven shaft parts being mutually supported with the intermediary of an hydraulic pressure line wherein a controllable pressure transducer is connected.

If both force input locations are selected so that the worm gears of both worm transmissions have mutually opposing rotary senses, then the displaceable bearings need only brace or support one another in one direction of displacement. When the rotary direction of the machine is reversed i.e. during reverse operation thereof, the ends of both main drive shafts coupled one to another are mutually braced or supported. In this case then 50% of the total power would be allotted to both worm transmissions, respectively.

In accordance with yet other features and an alternate embodiment of the invention, the drive train is constructed as a continuous main drive shaft, a respective worm transmission and a respective spur gear pair connected thereto both connecting the main drive shaft at each of the force input locations to the gear train, one of the gears of each of the spur gears pairs being in meshing engagement with a respective spur gear of the gear train, the one gears of the spur gear pairs being displaceably suspended in bearings, each of the bearings being constructed as hydraulic cylinders, respective bearing pistons being displaceably mounted in the hydraulic cylinders, the other gears of the spur gear pairs being suspended respectively through bearing and supporting members on the respective pistons, pressure chambers being located respectively on both sides of each of the pistons, the pressure chambers for one of the bearings being connected through hydraulic pressure lines and an intermediately connected regulatable pressure transducer to the pressure chambers for the corresponding other bearing.

Instead of the main drive shaft with the two worm transmissions, a closed gear train can also be employed as the drive train, in accordance with the invention.

In accordance with another embodiment of the invention, the drive gear of the gear train at one of the force input locations has a direction of rotation that is opposite to the direction of rotation of that of the drive gear of the gear train at the other of the force input locations and the transmission means form-lockingly connects both of the transmission members one to another, at least one of the transmission members being mounted on displaceable bearings, and force generating means are provided which act upon the one transmission member in direction of the displaceable bearing thereof.

The floating bearing system of the aforementioned transmission members as well as the form-locking connection thereof one to the other ensure, because of the additional force exerted on one of the transmission members, such a power input to the force input locations that the overdefining of the total drive is eliminated. Care is taken that in the middle endangered region of the gear train, power will always flow in one direction, the amount thereof being determined by the applied additional force. The engagement of the driving tooth flanks of the gears in the gear train is consequently always assured. Even load deviations cannot have any disadvantageous effect because the force generator can be made adjustable or automatically regulatable in dependence upon the power requirement of the individual printing units. Accordingly, difficulties of so-called doubling in the case of multicolor sheet-fed offset printing machines or misalignments in the case of multicolor sheet-fed high-speed printing machines, insofar as they may be caused by a gear tooth flank change, are completely avoided.

The most striking advantage of a device according to the invention is primarily the relative simplicity thereof. With only slight changes in the heretofore known drives, the harmful overdefining may already be avoided. In accordance with a further embodiment of the invention, which makes the foregoing advantage particularly clear, the drive train is constructed as a continuous main drive shaft, a pair of drive worms having opposite pitch directions are secured on the main drive shaft, the latter is mounted so as to be axially displaceable, and the force generating means comprises a force generator that exerts a force on one end of the main drive shaft, in axial direction thereof. In accordance with an additional feature of this embodiment, the force generator is a compression spring.

Although the invention is illustrated and described herein as embodied in drive for sheet-fed rotary printing presses with at least two tandem-mounted printing units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
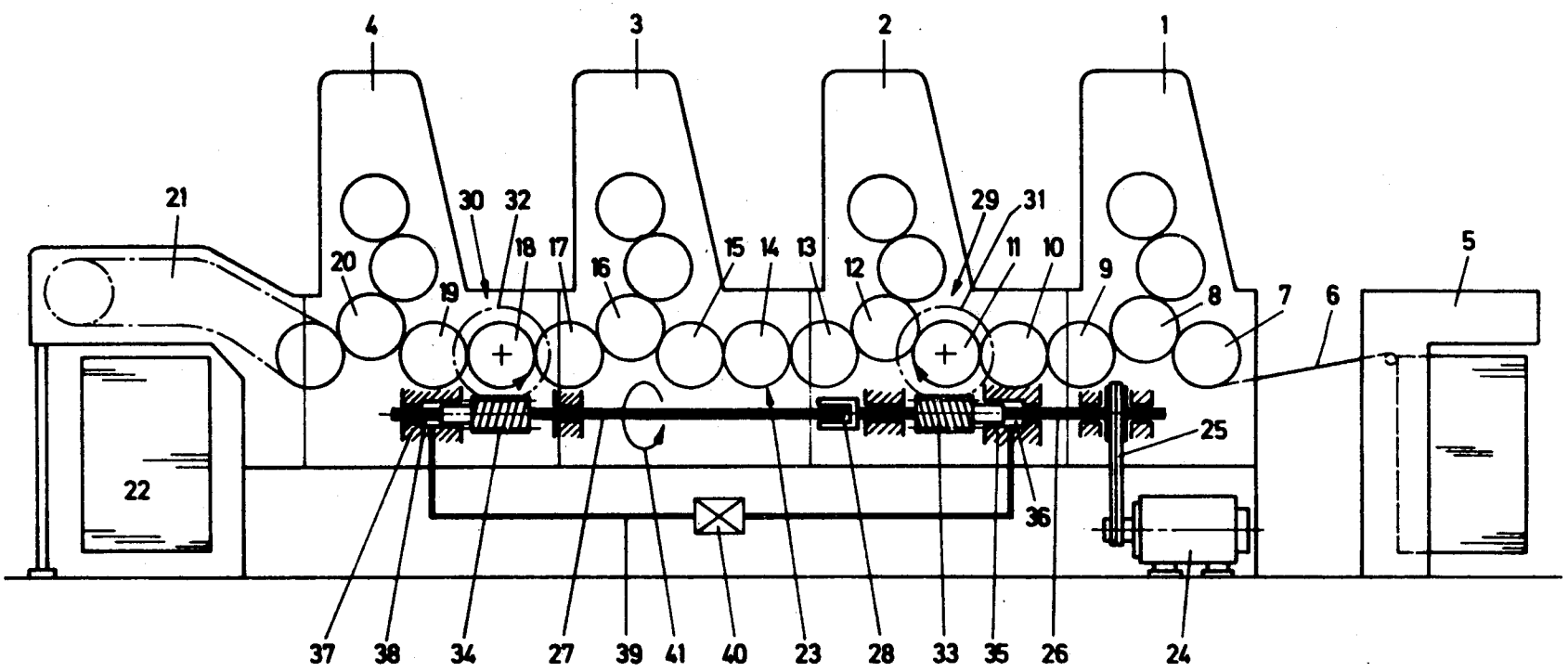
FIG. 1 is diagrammatic view of a multicolor sheet-fed rotary offset printing machine having a divided main drive shaft as well as axially displaceably mounted shaft parts.

Referring now to the drawing and first particularly to FIG. 1 thereof, there is shown a multicolor sheet-fed rotary offset printing machine having four offset printing units 1, 2, 3 and 4. A sheet that is to be imprinted is fed from the sheet feeder 5 over a feed table 6 and a supply drum 7 to the printing cylinder 8 of the printing unit 1.

After being imprinted, the sheet travels over the three transfer cylinders 9, 10 and 11 to the impression cylinder 12 of the printing unit 2. At the latter, the sheet receives a second printing and is then advanced over three transfer cylinders 13, 14 and 15 to the impression cylinder 16 of the printing unit 3. The thrice imprinted sheet is thereafter fed over transfer cylinders 17, 18 and 19 to the impression cylinder 20 of the printing unit 4, receives the fourth imprinting thereat and is than taken over by an endless chain delivery system 21 and delivered to a delivery pile 22.

On each shaft of the aforementioned cylinders 7 to 20, a spur gear having a diameter corresponding to that of the cylinders is respectively secured at the drive side of the printing machine. The spur gear of all the cylinders 7 to 20 form a gear train 23 i.e. all of the spur gears mesh one with the other and consequently, in addition to ensuring the drive for the printing machine, they also ensure synchronization of the four printing units 1 to 4.

The power consumed by the individual aggregations of the printing machine is produced by a motor 24 which drives a divided main drive shaft 26, 27 extending parallel to the gear train 23 by means of a belt drive or transmission 25. Both main drive shaft parts 26 and 27 are mounted connected one to the other by a coupling 28 in rotary direction, and mutually displaceable in axial direction. The connection at both ends of the main drive shaft parts 26 and 27 is such that they can move away one from the other from a zero or neutral position, yet can mutually support or brace one another in opposite direction.

The gear train 23 has two force input locations 29 and 30. In the first force input location 29, a worm gear 31 is secured to the transfer cylinder 11 connected directly forward of the printing unit 2, as viewed in the sheet feed direction of FIG. 1, and in the second force input location 30, a worm gear 32 is secured to the shaft of the intermediate transfer cylinder 18 located between the printing units 3 and 4. The worm gear 31 meshes with a worm 33 keyed on the main drive shaft part 26, and worm gear 32 meshes with a worm 34 mounted on the main drive shaft part 27. The pitch or thread direction of the two worms 33 and 34 are opposed to one another, one being a left-hand thread and the other a right-hand thread.

A bearing 35 with an hydraulic pressure chamber 36 is provided between the worm 33 and the belt transmission 25. The pressure chamber 36 absorbs the axial force of the worm 33 during forward operation of the machine. In a similar manner, at the rear end of the main drive shaft part 27 adjacent the worm 34, a similar bearing 37 with an hydraulic pressure chamber 38 is provided. The pressure chamber 38 serves to absorb the axial forces of the worm 34 during forward operation of the machine. Both pressure chambers 36 and 38 are connected one to the other by an hydraulic pressure line 39. An adjustable force or pressure transducer 40 is provided in the pressure line 39 and is adjustable so that, for example, the pressure chamber 36 can intercept or sustain a greater axial force than the pressure chamber 38.

The operation of the aforedescribed drive is as follows:

During the forward operation of the printing machine, the motor 24 drives the main drive shaft 26, 27 in the rotary direction represented by the curved arrow 41. Correspondingly, the worm gear 31 rotates in clockwise direction and the worm gear 32 in counterclockwise direction, as viewed in FIG. 1. The axial forces produced by both worms 33 and 34 tend to force apart the main drive shaft parts 26 and 27 which are axially displaceably mounted and are mutually coupled only in rotary direction. The hydraulic pressure chambers 36 and 38 mutually connected through the line 39 and the pressure transducer 40 absorb the axial pressures of the worms 33 and 34 and thus counteract an axial displacement of the main drive shaft parts 26 and 27. An equilibrium condition is set up. Depending upon the adjustment of the pressure transducer or converter 40, for example, the pressure chamber 38 can absorb more or less axial pressure than the other corresponding pressure chamber 36. The portions of power transmitted by both worm transmissions 31, 33 and 32, 34 behave correspondingly.

Figure 2:
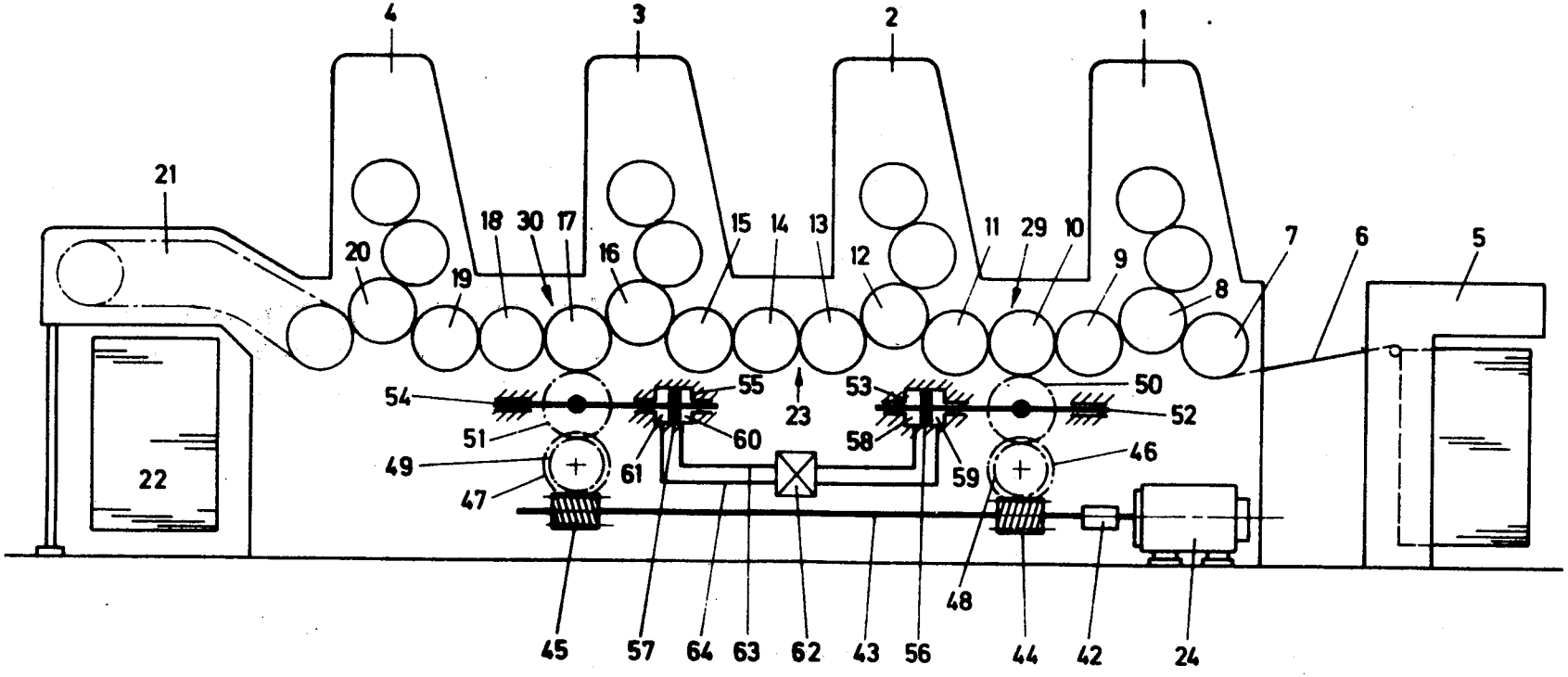
FIG. 2 is a diagrammatic view of a multicolor sheet-fed rotary offset printing machine having spur gears mounted displaceable parallel to the drive train.

The multicolor sheet-fed rotary offset printing machines shown in FIG. 2 corresponds completely to the aforedescribed machine shown in FIG. 1, with respect to the arrangement of the printing units 1 to 4, the sheet feeder 5, the delivery 21 and the gear train 23. The only differences between the two machines are the location at which power is introduced into the gear train 23 as well as the construction of the drive train of the invention.

In the embodiment of FIG. 2, the drive motor 24 is firmly connected through a coupling 42 to a continuous main drive shaft 43 on which two worms 44 and 45 are rigidly mounted. The worms 44 and 45 are in meshing engagement, respectively, with worm gears 46 and 47, on the shafts of which respective spur gear 48 and 49 are keyed which, in turn, mesh with respective spur gears 50 and 51 that are located above the respective worm transmissions 44, 46 and 45, 47.

Both of the last-mentioned spur gears 50 and 51 are displaceably suspended parallel to the main drive shaft 43 and are respectively meshed with a gear of the gear train 23. The first force input location 29 is located, however, in contrast to the embodiment of FIG. 1, at the transfer cylinder 10, and the second force input location 30 is located at the transfer cylinder 17. The spur gear 50 is displaceably suspended in bearings 52 and 53, and the other spur gear 51 in the bearings 54 and 55.

The two bearings 53 and 55 disposed between the force input locations 29 and 30 are constructed as hydraulic cylinders wherein, respectively, bearing pistons 56 and 57 are displaceably mounted. Hydraulic pressure chambers 58, 59 and 60, 61 are located, respectively, on both sides of the bearing pistons 56 and 57. The pressure chambers 58 and 60 facing toward one another are connected one to the other by an hydraulic pressure line 63 with the intermediary of a pressure transducer 62.

Also, the two other pressure chambers 59 and 61 are connected by a hydraulic pressure line 64 and the aforementioned pressure transducer 62.

Figure 3:
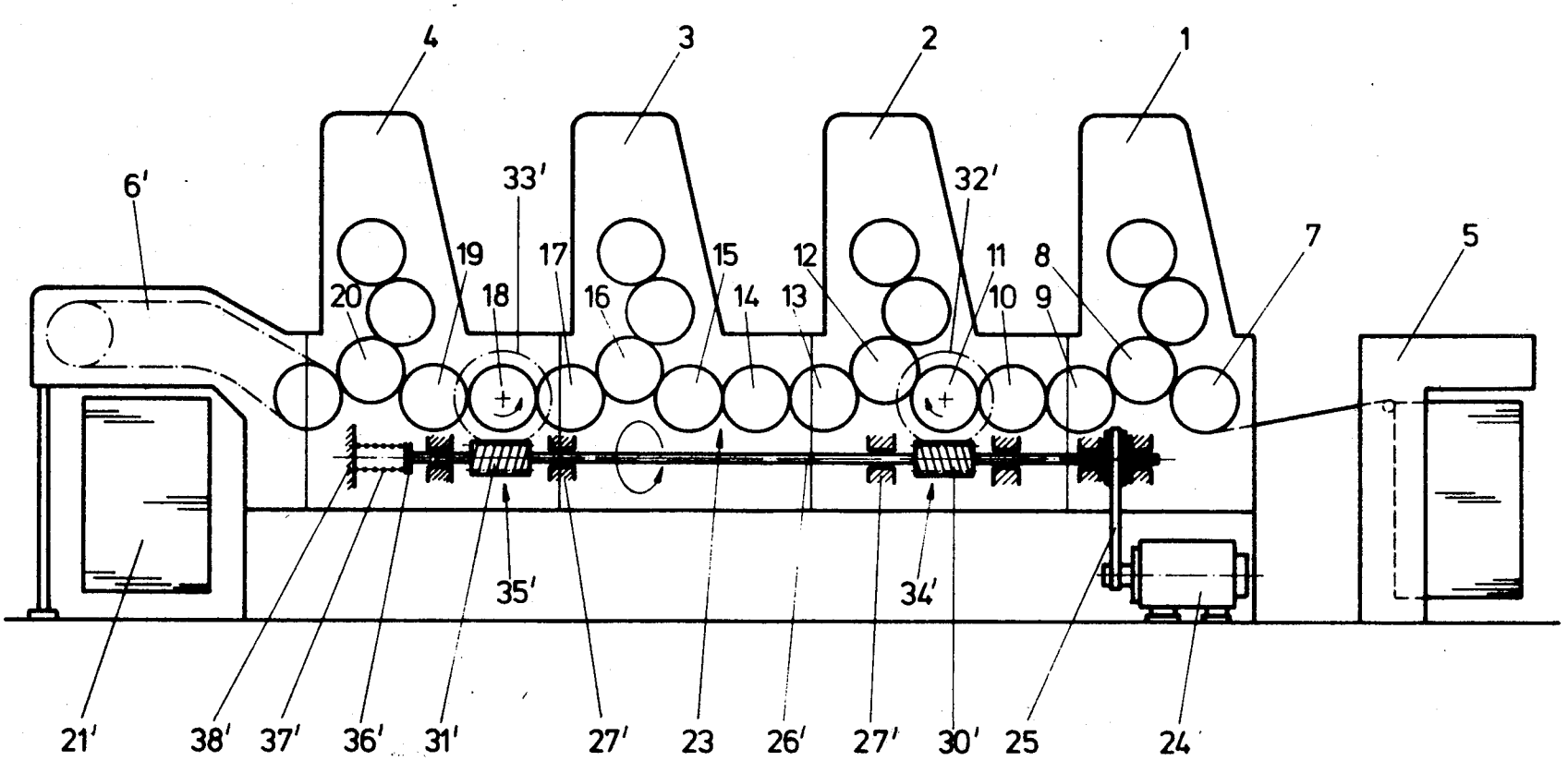
FIG. 3 is a diagrammatic view of a four-color sheet-fed rotary offset printing machine that has another embodiment of the drive of FIG. 1.

The pressure transducer is controllable. Moreover, with a change in rotary direction of the machine, it can be switched over from line 63 to line 64. During forward operation of the machine, the pressure chambers 58 and 60 are subjected to load. Adjustment of the pressure transducer 62 determines the proportion of the axial forces of the drive that is to be absorbed by each of the pressure chambers 58 and 60. The adjusted axial forces determine, in turn, the amount of the power fed from the associated worm spur gear drive into the force input locations 29 and 30, respectively. Thus, the power delivered from the motor 24 can be divided between both force input locations 29 and 30, as desired, through manual adjustment or through automatic regulation of the pressure transducer 62. Thereby, the drive constructed in accordance with the invention is adjustable to the particular power requirement of individual aggregations or printing units of the multicolor sheet-fed rotary printing machine. In FIG. 3, there is shown a four-color sheet-fed rotary offset printing machine having serially disposed printing units 1, 2, 3 and 4 as in the embodiments of FIGS. 2 and 3. Also as in the aforedescribed embodiments, in the embodiment of FIG. 3, a sheet feeder 5 is located forward of the printing unit 1. A chain delivery 6' is mounted following the fourth printing unit 4.

A sheet fed from the sheet feeder 5 travels over the supply or feed drum 7 to the impression cylinder 8 of the printing unit 1 of the embodiment of FIG. 3, the same as in the embodiments of FIGS. 1 and 2, receives a first printing, and is then fed to the impression cylinder of the second printing unit 2 over three transfer cylinders 9, 10 and 11. At the latter, the sheet receives a second imprint and is then advanced over three transfer drums 13, 14 and 15 to the impression cylinder 16 of the printing unit 3, in the same manner as in the embodiments of FIGS. 1 and 2. From the printing unit 3, the thrice imprinted sheet is fed over transfer drums 17, 18 and 19 to the impression cylinder 20 of the printing unit 4, receives a fourth printing there and is thereafter taken over by the endless chain delivery 6' and deposited on the delivery pile 21'.

On every shaft of the aforementioned cylinders 7 to 20 of FIG. 3, a respective spur gear is secured at the drive side of the machine, the diameter of the spur gears corresponding to that of the cylinders 7 to 20. The gears of all of the cylinders 7 to 20 form a gear train 23 as in the embodiments of FIGS. 1 and 2. The respective consecutive spur gears of the gear train 23 mesh one with the other and, in addition to assuring the drive, also assure synchronization of the four printing units 1 to 4.

The power consumed by the individual aggregations or printing units of the machine is produced by a motor 24 which drives by means of a belt transmission 25 a continuous main drive shaft 26' extending parallel to the gear train 23. All of the bearings 27' of the continuous main drive shaft 26' are constructed so that the main drive shaft is displaceable in axial direction.

Two drive worms 30' and 31', respectively having a left-hand and a right-hand thread, are secured on the main drive shaft 26'. The drive worm 30' meshes with a worm gear 32' which is secured on the shaft of the transfer drum 11. The other drive worm 31' drives the shaft of the transfer drum 18 through a worm gear 33'. The one force input location 34' of the gear train 23 is thus located at the transfer drum 11 directly forward of the printing unit 2, while the second force input location 35' is provided at the transfer drum 18 located between the printing units 3 and 4.

The end of the main drive shaft 26' located at the left-hand side of FIG. 3, and which faces away from the motor 24, is provided with an axial bearing 36' against which a compression spring 37' bears at one end thereof in axial direction of the main drive shaft 26'. The other end of the compression spring 37' is braced against a stationary supporting surface 38' of the machine housing, which can, however, also be constructed so as to be adjustable, so that the biasing force from the compression spring 37' acting upon the main drive shaft 26' can be variable in strength.

Because of the floating bearing suspension of the main drive shaft 26' as well as the different direction of operation or travel of the two drive worms 30' and 31', 50% of the power would be fed, respectively, into both force input locations 34' and 35' as long as the compression spring 37' exerts no pressure on the main drive shaft 26'. Due to the application of the force of the compression spring 37', however, a predetermined portion *a* of the power is additionally supplied at the force input location 35', and the amount of power fed to the force input location 34' is diminished by exactly the same quantity *a* of power. In the intermediate region of the gear train 23 at the transfer drums 13, 14 and 15, namely, an amount *a* of the power thus continuously flows and, because of the adjustment of the compression spring 37', can be maintained so that even when there are deviations in the power to the individual aggregates or printing units of the machine, no raising of the driving flanks of the gear teeth will occur.

As aforementioned, the invention of this application is not limited merely to the aforedescribed embodiments. It is conceivable, for example, also to provide multicolor sheet-fed rotary printing machines with three and more force input locations wherein, in a similar manner, movably mounted transmission members can be used in connection with a force transducer or translator. It is also possible to effect a suspension of the spur gears 50 and 51 in a different manner than that if the embodiment of FIG. 2. For example, instead of the spur gears 50 and 51, respective intermediate gear wheels or idlers (such as in intermediate gear shears or brackets) are mounted so as to be pivotable about the axis of one of the adjacent spur gears. The support devices, which can be of mechanical or hydraulic construction, are then clamped to the intermediate gear shears or brackets.

Furthermore, the continuous main drive shaft of the embodiment of FIG. 3 can also be subdivided so that both drive worms are for themselves floatingly mounted. The form-locking coupling of both displaceable bearings of the embodiment of FIG. 3 can be effected by suitable transmission means. For the operation of the embodiment of FIG. 3, it is moreover immaterial upon which of the two displaceably mounted drive members, the force generator, for example, the compression spring 37', acts.

I claim:

1. Drive for sheet-fed rotary printing machines with at least two tandem-mounted printing units having a drive motor, comprising a closed gear train connecting the printing units to each other, a continuous main drive shaft driven by the drive motor and extending parallel to said closed gear train, and main drive shaft being mounted so as to be axially displaceable, a pair of drive worms having opposing pitch directions secured on said main drive shaft, worm gears in meshing engagement with said drive worms and connecting said main drive shaft thereby to said closed gear train at two force input locations, and force generating means comprising a force generator exerting a force on one end of said main drive shaft in axial direction thereof.

2. Drive according to claim 1 wherein said force generator is adjustable with respect to the force produced thereby.

3. Drive according to claim 1 wherein said force producer is a compression spring in biasing engagement with an axial bearing mounted at said one end of said main drive shaft.

* * * * *